US005468163A

United States Patent [19]

Egenolf

[11] Patent Number: 5,468,163

[45] Date of Patent: Nov. 21, 1995

[54] ELECTRICAL TERMINAL FOR USE WITH SHORT CIRCUIT SPRING CONTACTS

[75] Inventor: Bernhard Egenolf, Dreieich, Germany

[73] Assignee: The Whitaker Corporation, Wilmington, Del.

[21] Appl. No.: 258,649

[22] Filed: Jun. 13, 1994

[30] Foreign Application Priority Data

Jul. 22, 1993 [GB] United Kingdom ..... 9315160

[51] Int. Cl.[6] ..... H01R 4/48

[52] U.S. Cl. ..... 439/839; 439/851

[58] Field of Search ..... 439/842, 843, 439/849, 850, 833, 839, 851–856, 861, 886

[56] References Cited

U.S. PATENT DOCUMENTS 4,462,657 7/1984 Snowdon et al. ..... 439/886
4,685,761 8/1987 Locati ..... 439/886
4,981,450 1/1991 Salvatore ..... 439/886

FOREIGN PATENT DOCUMENTS

0517077A2 12/1992 European Pat. Off. .
0517076A2 12/1992 European Pat. Off. .
0517139A2 12/1992 European Pat. Off. .

*Primary Examiner*—David L. Pirlot
*Attorney, Agent, or Firm*—Adrian J. LaRue; Eric J. Groen

[57] ABSTRACT

An electrical terminal comprises an outer back-up spring and an inner contact body. The inner contact body is provided with resilient contacts in its middle body section that bias against a plated inner surface of the back-up spring for electrical contact therewith. The back-up spring has on an outer surface a gold plated band that serves as a zone for electrical contact with a short circuit spring terminal. Reliable electrical contact is therefore made between a short circuit spring terminal and the inner contact body of this terminal.

14 Claims, 4 Drawing Sheets

ELECTRICAL TERMINAL FOR USE WITH SHORT CIRCUIT SPRING CONTACTS

BACKGROUND OF THE INVENTION

1. Field of the Invention

This invention relates to an electrical terminal comprising an inner contact body and an outer back-up spring, the terminal comprising contacts for making electrical connection between the back-up spring and the contact body to ensure good electrical connection between the inner contact body and a short circuit spring terminal making contact on an outer surface of the back-up spring.

2. Summary of the Prior Art

In the electrical industry it is common to find the use of terminals having an inner contact body and an outer back-up spring. The outer back-up spring is usually made of a metal such as stainless steel having good spring properties which are not altered by high mechanical solicitation such as vibration, or high temperatures, the outer back-up spring serving to increase the spring force of the inner contact body for increased electrical conductivity at the contact surfaces of mating terminals. Due to the back-up spring, the inner contact body can be manufactured from a good conducting material that also has good crimping properties for connection to conducting wires, these materials usually having poor spring properties. Such terminals are described in the following European patent application publications 0517076, 0517077, 0517139, which are included herein by way of reference. Terminals with outer back-up springs such as described above, can be used in many different applications, but find many applications in automobile connectors which are subject to harsh environmental conditions such as vibration, temperature and corrosive agents such as salt. Such terminals are also found in connectors for the detonation of airbags in the event of collision. Airbag connectors comprise short circuit spring terminals that electrically connect certain adjacent terminals thereof when the airbag connector is unmated (for maintenance or repair reasons for example), the short circuit spring terminal ensuring that the electrical potential difference between certain adjacent unmated terminals is zero to preclude unwanted detonation of the airbag. Good electrical contact between the short circuit spring terminal and the inner contact body of the adjacent terminals must therefore be guaranteed. Unfortunately, although there is contact between the outer back-up spring and the inner contact body, electrical contact therebetween is unreliable due to oxide layers forming between the contact surfaces of the inner contact body and outer back-up spring. The outer back-up spring material is chosen for it's main function, which is to support and increase the contact force of the inner contact body against a mating terminal, and also to provide retention means for locking the terminal in the cavity of connector housing, the electrical contact properties between the inner contact body and the outer back-up spring having been a second consideration. The inner contact body commonly is tin plated whereby the outer back-up spring is typically of stainless steel. In a corrosive environment, an oxide layer will form on the tin plating which will adversely affect electrical contact between the outer back-up spring and the inner contact body, the latter effect being aggravated by the electrolytic potential formed therebetween due to the different contact materials.

The outer back-up spring renders access to the inner contact body difficult for the short circuit spring which must therefore make contact with the outer back-up spring. The contact of the short circuit spring terminal is gold plated to preclude oxide layers forming thereon. The outer back-up spring, even though made from stainless steel, may still oxidize under a very corrosive environment such as the salt found in automobiles, once again accentuated by the differing contact materials.

SUMMARY OF THE INVENTION

It is therefore an object of this invention to provide an electrical terminal comprising an inner contact body and an outer back-up spring, for use with short circuit spring contacts.

It is a further object of this invention to provide the terminal above in a cost-effective manner.

The objects of this invention have been achieved by providing an electrical terminal comprising an inner contact body and an outer back-up spring, characterized in that the terminal comprises contacts for making electrical contact between the back-up spring and the inner contact body.

DETAILED DESCRIPTION OF THE PREFERRED EMBODIMENT

Figure 5:
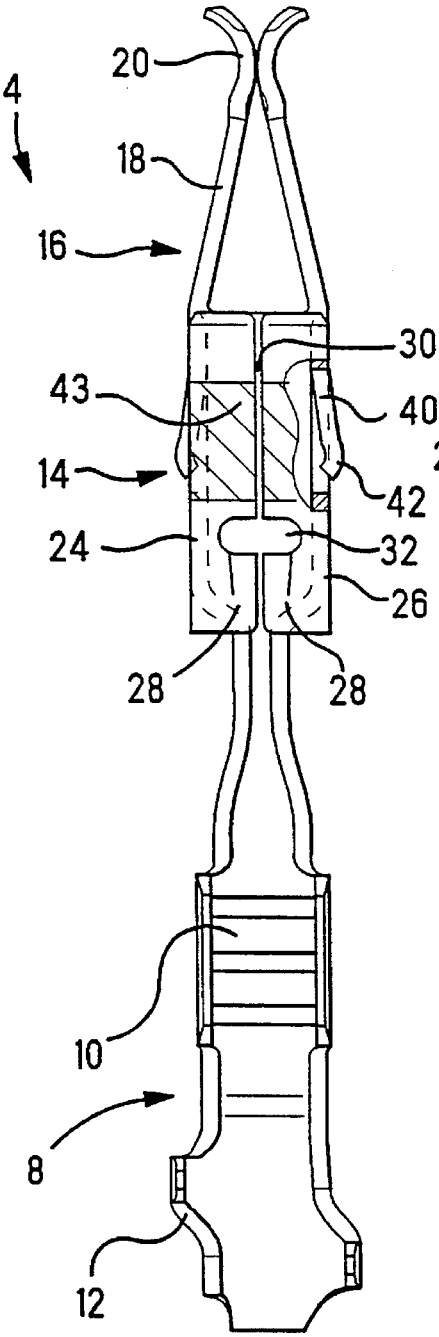
FIGS. 5 to 7 are respectively, top, side cross-sectional, and front-end views of the inner contact body.
Figure 6:
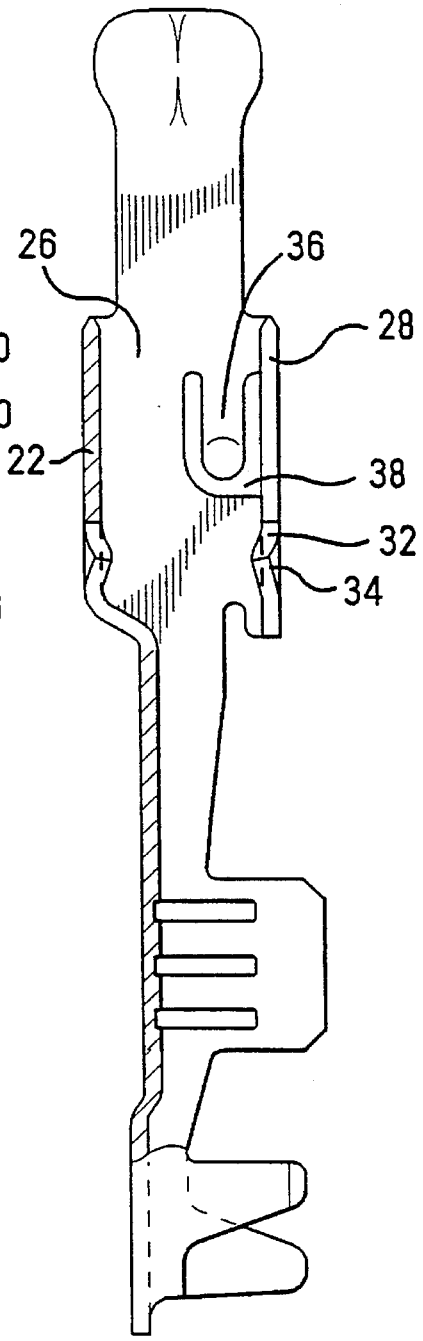
Figure 7:
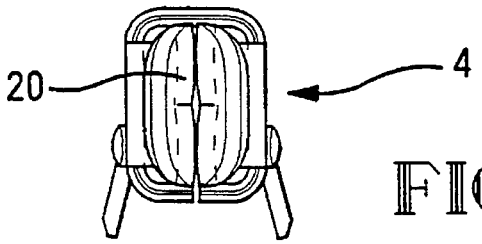
Figure 10:
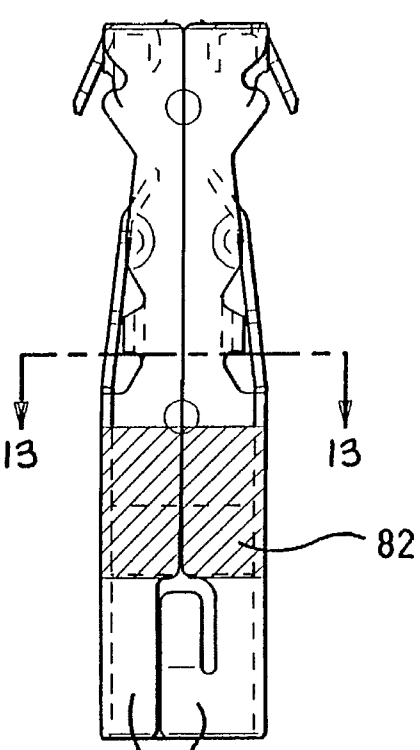
FIGS. 8 to 10 are respectively top, side and bottom views of the outer back-up spring.
Figure 13:
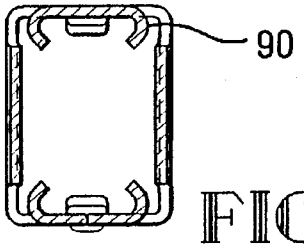
FIG. 13 is a cross-sectional view through lines 13—13 of FIG. 10.
Figure 9:
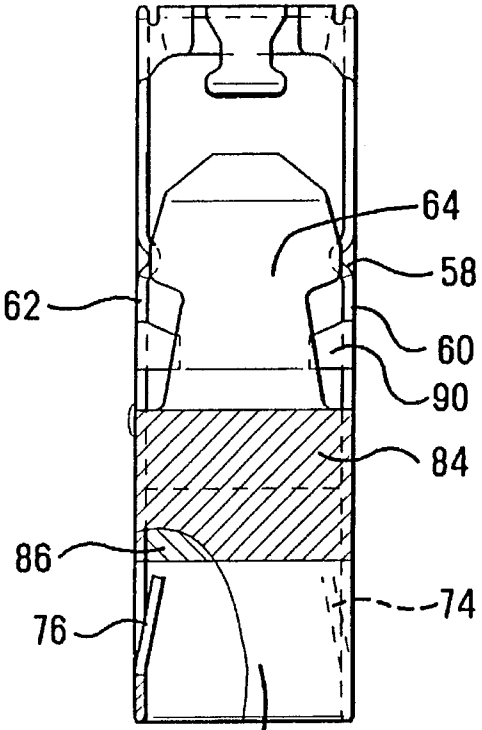
Figure 12:
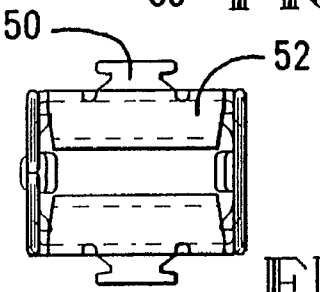
FIG. 12 is a front-end view of the back-up spring.
Figure 8:
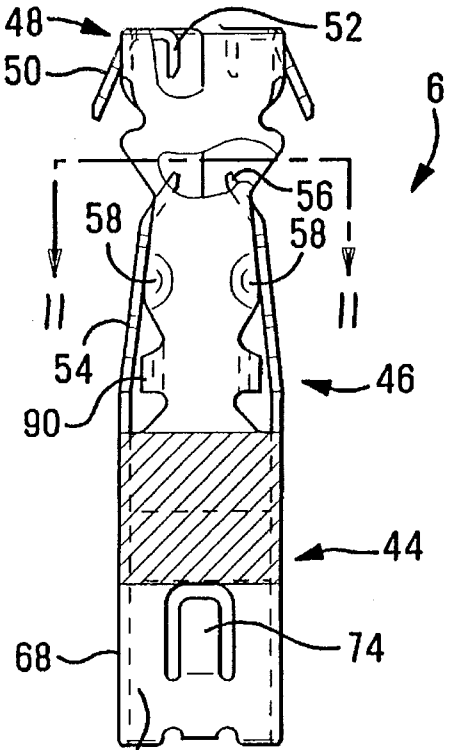
Figure 11:
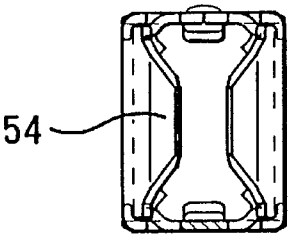
FIG. 11 is a cross-sectional view through lines 11—11 of FIG. 8.

Referring to FIGS. 1 to 4, an electrical terminal generally shown at 2 comprises an inner contact body 4 and an outer back-up spring 6. Referring now to FIGS. 5, 6 and 7, the inner contact body 4 will be described in more detail. The inner contact body 4 comprises a wire connection section 8 comprised of a crimping barrel 10 and wire strain relief means 12, a box-shaped central body section 14 attached to the connection section 8, and extending from the body section 14 is a contact section 16 comprising a pair of resilient arms 18 extending obliquely towards each other and having flared contact portions 20 at their free ends for making contact to a mating male tab terminal. The central body section 14 comprises a bottom wall 22, side walls 24, 26, and a pair of top half walls 28 proximate each other along a central longitudinal seam 30. The central body section 14 also comprises on the bottom and top walls, oval cutouts 32 indented at a rear end 34. Stamped and formed out of the side walls 24, 26 are resilient contacts 36 surrounded by a U-shaped cutout 38. The contacts 36 depart obliquely outwardly and rearwardly from a forward portion of the contact section body 14, and comprise a resilient contact arm 40 extending into an embossed contact portion 42. A Selectively plated gold band 43 encircles the outer surface of the middle section 14 so encompass the contacts 36.

Referring to FIGS. 8 to 13, the outer back-up spring will now be described in more detail. The outer back-up spring 6 comprises a body section 44, extending at a front end into a spring arm section 46 which further extends into a tab entry section 48 that comprises locking lances 50 and tab entry guide members 52. The spring arm section 46 comprises a pair of spaced apart opposed spring arms 54 having a bent free end 56 for applying pressure to the contact arms 18 of the inner contact body 4. The spring arms 54 are held apart at a predetermined distance by indents 58 stamped inwardly from the edges of top and bottom walls 60, 62 respectively that interfere with a wider central portion 64 of the spring arms 54. The indents 58 serve to hold the free ends 56 slightly apart from the inner contact body contact arms 18 so as to reduce the insertion force of a mating tab terminal due to the contact arms 18 only engaging the spring arms 54 once the terminal has been partially inserted between the contact portions 20.

Figure 1:
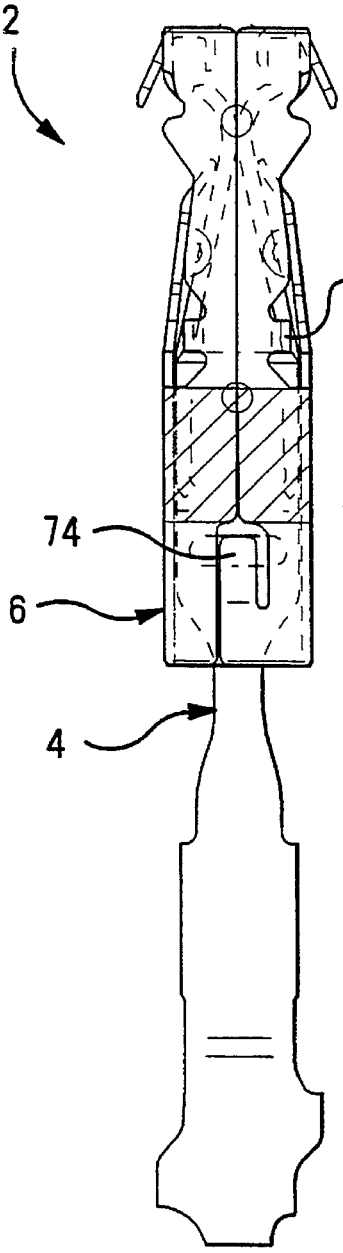
FIGS. 1 to 4 are respectively bottom, side with partial cross-section, top, and front-end views of an electrical terminal comprising an inner contact body and an outer back-up spring.
Figure 2:
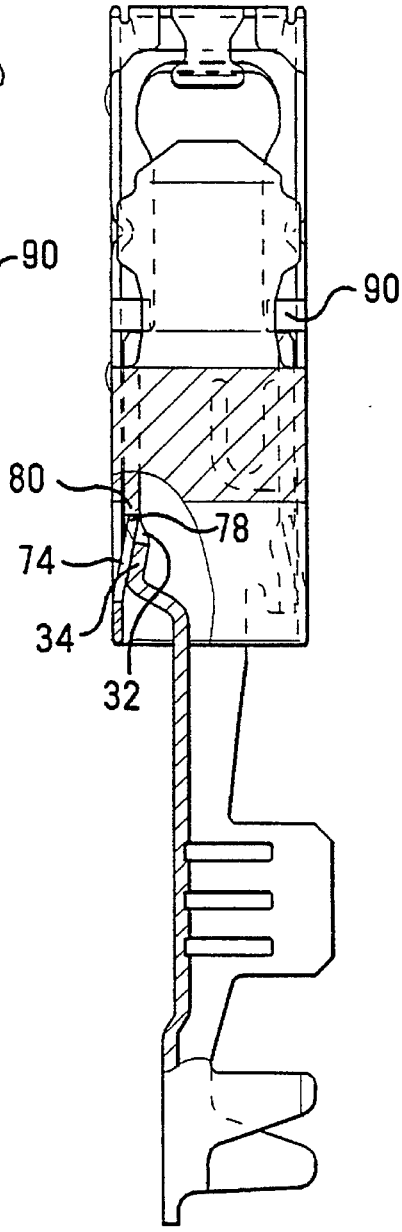
Figure 3:
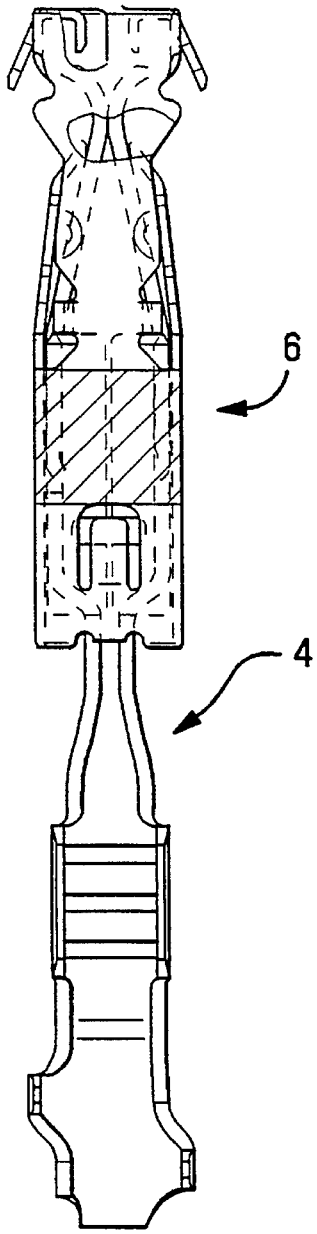
Figure 4:
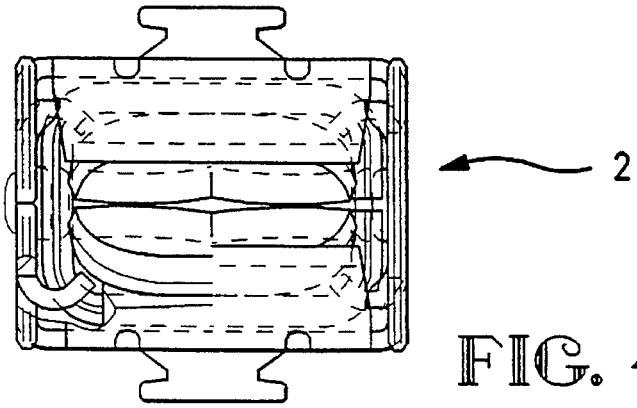

The body section 44 has a rectangular cross-section and comprises a top wall 66, side walls 68 and bottom half walls 70, 72. Stamped from the top and bottom walls 66, 72 respectively, are bent forwardly and inwardly resilient locking lances 74, 76 that serve to retain the outer back-up spring 6 from moving forwardly with respect to the inner contact body 6, the tabs 74, 76 engaging in the oval windows 32 as shown in FIG. 2, whereby the indent 34 serves to lower the free end 78 of the locking lance 74 against the forward edge 80 of the oval window 32. The body section 44 also comprises an outer band of gold plating 82 that encircles approximately the forward half section of the body section 44. The gold plated band 82, defines on the side walls 66, a short circuit spring contact zone 84. On an inner surface of the body section walls 66, 68, 70, 72 is another gold plated band 86 that defines on the inside of the side walls 68, a contact zone for the inner body contacts 36.

Figure 14:
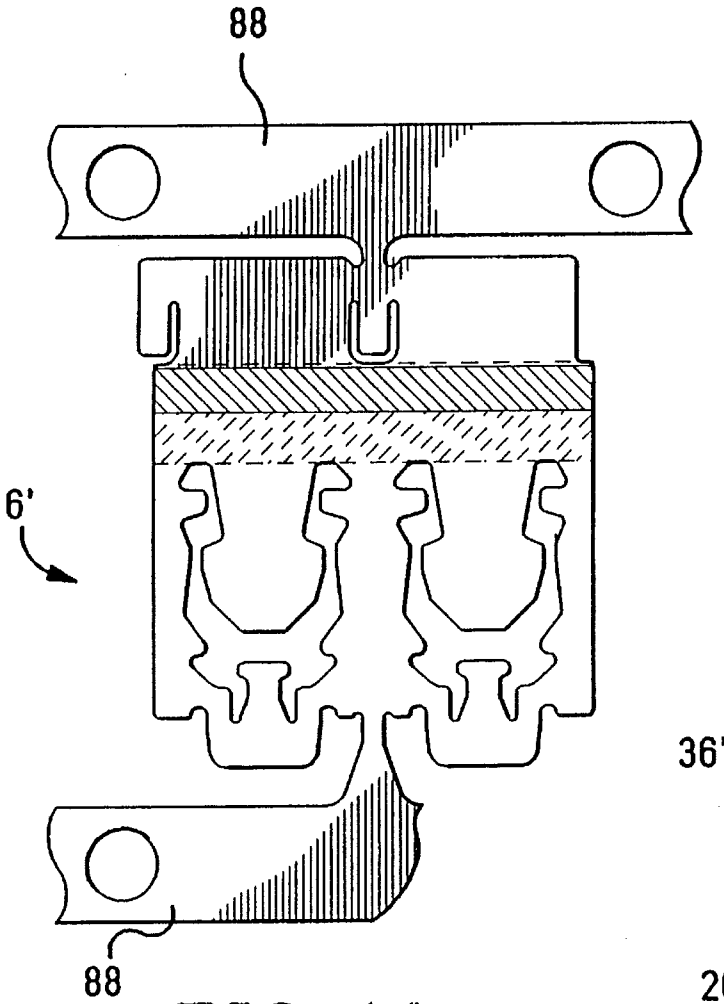
FIG. 14 is a partially complete back-up spring stamped from sheet metal and still attached to carrier strips.

Referring now to FIG. 14, the inner and outer plated bands 82, 86 are plated onto the back-up spring 6 whilst it is only partially manufactured; more particularly whilst it is still attached to carrier strips 88 such that the edge stamped back-up springs 6' can be run past plating baths, whereby to reduce gold usage, the back-up springs 6' are selectively plated in the thin bands 82, 86 that covers with a certain tolerance the area in which contact is made to the short circuit spring terminal and to the inner body contacts 36.

Figure 15:
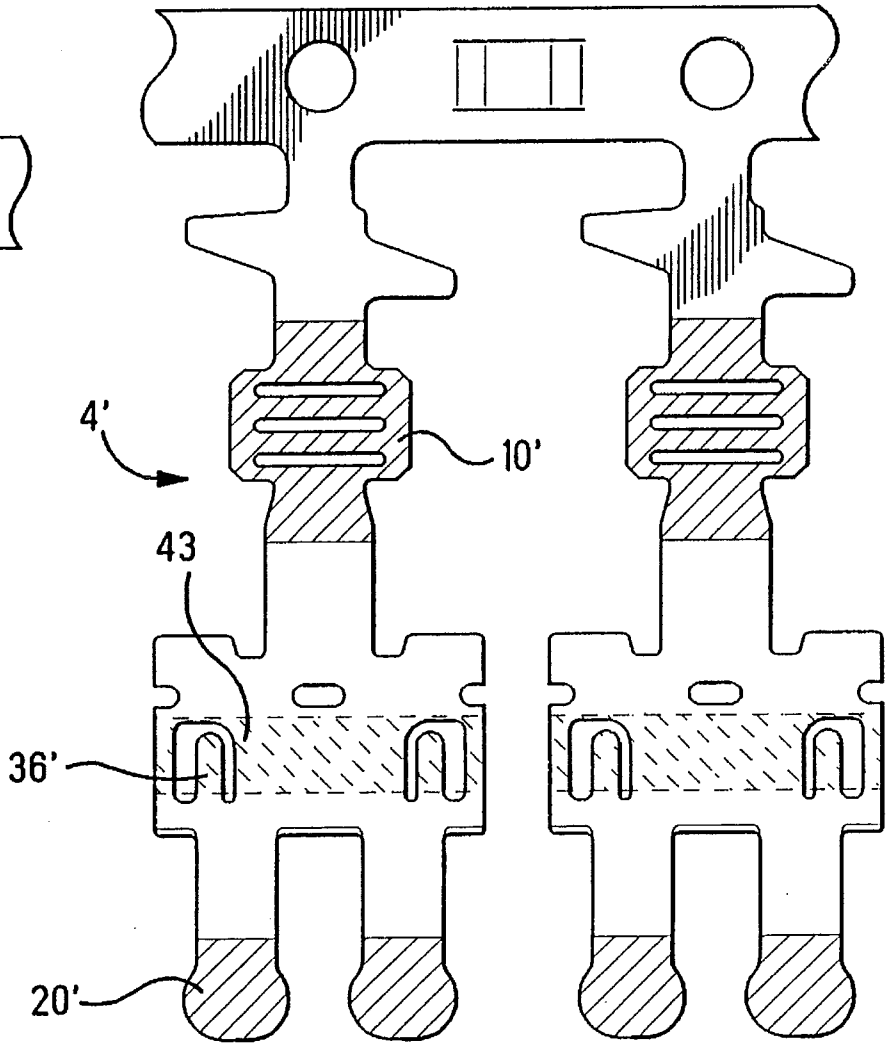
FIG. 15 is partially complete inner contact body stamped from sheet metal and still attached to a carrier strip.

Referring now to FIG. 15, the inner contact body 4' is selectively plated 43 in a similar manner, whereby in this embodiment, the crimped barrel zone 10', the contact portions 20', and the middle section contacts 36' are plated, plating 43 of the middle section contacts being in gold in the preferred embodiment, whereby it is only necessary to plate the outer surface of the middle section 14 in the region of the contact surfaces 42.

Referring back to FIGS. 1 to 4, the completed outer back-up spring 6 can be assembled to the inner body 4 by inserting it over the inner body contact arms 18 and over the middle section 14 until the locking lances 74 engage in the oval windows 32, and bent in tabs 90 projecting inwards from the back-up spring top and bottom walls 66, 70, 72 simultaneously abut the forward end of the inner body middle section 14 for rearwards retention of the back-up spring. As the back-up spring is inserted over the inner contact body 4, the outer back-up spring arms 54 are biased outwards to pass over the flared ends of the inner body contact portions 20, but in their fully assembled position the spring arm tips 56 are held slightly off the contact arms 18 by the spacer indents 58 as already described above. This therefore means that there is no electrical contact between the back-up spring arm tips 56 and the inner contact body 4, contact only being made between the back-up spring body section 44 and the inner contact body middle section 14. The outer back-up spring 6 is more or less loosely seated over the contact body middle section 14, and in the prior art (see publications EP-0517076, 0517077 and 0517139) there is no specific position where controlled pressure is applied between the outer back-up spring and the inner contact body to ensure electrical contact therebetween. Additionally, stamping and forming of the back-up spring, without it passing through plating baths, does not remove the film of oil on the back-up spring that is gathered during the manufacturing process, this oil film obviously impairing electrical conductivity between the back-up spring and inner contact body.

In order to use these terminals for contact with short circuit spring terminals, it is necessary to provide a reliable electrical contact between the short circuit spring terminal (not shown) and the inner contact body 4. Good electrical contact between the inner body 4 and the outer back-up spring is made by the resilient contacts 36 that are gold plated, having an embossed contact portion 42 that is resiliently biased against the inner gold plated band 86 of the back-up spring, the plating precluding any corrosion at the contact surfaces. Good electrical contact between the short circuit spring terminal, which has gold plated contact surfaces, is made by plating the outer band 86, whereby this band is large enough to allow for tolerances in the relative positioning between the short circuit spring terminals and the terminals 4 within a connector housing, the mutually gold plated surfaces once again precluding any oxidation thereof and also ensuring during the plating process that the oil film on the back-up spring is removed.

Advantageously therefore, a reliable terminal comprising an inner contact body and an outer back-up spring, can be used in conjunction with a short circuit spring terminal and yet provide reliable electrical contact therebetween by plating the outer back-up spring inner and outer contact surfaces, and providing resilient plated contacts on the inner contact body that are biased against the plated inner band of the outer back-up spring. Another advantage is derived from the selective gold plating which results in a cost-effective terminal.

I claim:

1. An electrical terminal comprising an inner contact body and an outer back-up spring, the inner contact body comprising a contact section for mating with a complementary terminal, and a body section, the outer back-up spring surrounding and securely attached to the body section and comprising spring arms biasable against the inner body contact section for increasing the spring strength thereof, characterized in that the body section comprises contacts protruding outwardly therefrom for resiliently biasing against the outer back-up spring for making electrical contact between the backup spring and the inner contact body.

2. The terminal of claim 1, characterized in that the contacts of the body section are plated with a non-oxidizing conductive material.

3. The terminal of claim 1 characterized in that the inner contact body and back-up spring are selectively plated with a non-oxidizing conductive material in a region of contact therebetween.

4. The terminal of claim 1 characterized in that the outer back-up spring is selectively plated with a non-oxidizing material on an outer surface in a region where contact is made with a short circuit spring contact, the region large enough to allow for tolerances in the relative positioning of the short circuit spring and terminal in an electrical connector housing.

5. The terminal of claim 1, characterized in that the terminal comprises a pair of inner contacts.

6. The terminal of claims 2, 3, or 4, wherein said non-oxidizing material is gold.

7. The terminal of claim 1, characterized in that the inner contacts are stamped and formed out of the inner contact body.

8. The terminal of claim 7 characterized in that the inner contacts comprise a resilient arm having an embossed contact section at a free end thereof, the resilient arms prestressed such that the contact section is resiliently biased against the outer back-up spring.

9. An electrical terminal comprising an inner contact body and an outer back-up spring, the inner contact body comprising a contact section for mating with a complementary terminal, and a body section, the outer back-up spring surrounding and securely attached to the body section and comprising spring arms biasable against the inner body contact section for increasing the spring strength thereof, wherein the body section is selectively plated with a non-oxidizing conductive material in a region of electrical engagement between said back-up spring and said body section.

10. An electrical terminal of claim 9, wherein said back-up spring is selectively plated with a non-oxidizing conductive material in the region of electrical engagement between said back-up spring and said body section.

11. An electrical terminal of claim 9, wherein said outer back-up spring is selectively plated with a non-oxidizing material on an outer surface in a region where contact is made with a short circuit spring contact, the region large enough to allow for tolerances in the relative positioning of the short circuit spring and terminal in an electrical connector housing.

12. An electrical terminal of claim 9, wherein said body section has contacts protruding outwardly therefrom for resiliently biasing against the outer back-up spring for making electrical contact between the back-up spring and the inner contact body.

13. An electrical terminal of claim 12, wherein said contacts of the body section are plated with a non-oxidizing conductive material.

14. An electrical terminal of claims 9, 10, 11 or 13, wherein said non-oxidizing material is gold.

* * * * *